US007163279B2

(12) United States Patent
Shimizu et al.

(10) Patent No.: US 7,163,279 B2
(45) Date of Patent: Jan. 16, 2007

(54) INKJET HEAD HAVING RELAY MEMBER INTERPOSED BETWEEN PIEZOELECTRIC ELEMENT AND DIAPHRAGM

(75) Inventors: Kazuo Shimizu, Hitachinaka (JP); Osamu Machida, Hitachinaka (JP); Tomohiko Koda, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 147 days.

(21) Appl. No.: 10/874,283

(22) Filed: Jun. 24, 2004

(65) Prior Publication Data

US 2004/0263580 A1 Dec. 30, 2004

(30) Foreign Application Priority Data

Jun. 27, 2003 (JP) ..... P2003-184962

(51) Int. Cl.
*B41J 2/045* (2006.01)

(52) U.S. Cl. ..... 347/68; 347/70

(58) Field of Classification Search ..... 347/68, 347/70–72; 29/25.35
See application file for complete search history.

(56) References Cited

U.S. PATENT DOCUMENTS 4,751,774 A 6/1988 DeYoung et al.
5,639,508 A * 6/1997 Okawa et al. ..... 427/100
6,843,554 B1 * 1/2005 Nagata et al. ..... 347/68

FOREIGN PATENT DOCUMENTS

JP 3070625 7/2000
JP 2003305858 A * 10/2003
JP 2004001436 A * 1/2004

* cited by examiner

*Primary Examiner*—An H. Do
(74) *Attorney, Agent, or Firm*—Whitham, Curtis, Christofferson & Cook, PC

(57) ABSTRACT

A piezoelectric element is attached to a diaphragm via a relay member. A length of the relay member is shorter than the length of the piezoelectric element and longer than an active section in the piezoelectric element with respect to a direction orthogonal to a direction in which a plurality of nozzles are aligned. Also, a surface of the relay member that attached to the diaphragm has a width that is shorter than the piezoelectric element with respect to the direction in which the nozzles are aligned.

10 Claims, 4 Drawing Sheets

INKJET HEAD HAVING RELAY MEMBER INTERPOSED BETWEEN PIEZOELECTRIC ELEMENT AND DIAPHRAGM

BACKGROUND OF THE INVENTION

1. Field of the Invention

The present invention relates to a drop-on-demand multi-nozzle inkjet head having a plurality of nozzles, and also to an inkjet printing device including the inkjet head.

2. Related Art

Japanese Patent No. 3070625 proposes a technology for forming a dense arrangement of nozzles in an inkjet head by providing an array of long, thin protrusions on a diaphragm plate and using piezoelectric elements to deform the diaphragm plate through these protrusions. The protrusions on the diaphragm plate are formed of thin metal plates through etching or an electroforming method. Further, consideration has recently been given to a diaphragm plate having a two-layer construction, wherein a thin metal plate is laminated on a synthetic resin layer having excellent chemical resistance and protrusions are formed by etching a prescribed pattern in the metal layer, or else the protrusions are formed by electroforming a prescribed pattern on the synthetic resin layer. By deforming the diaphragm plate with piezoelectric elements through these protrusions, it is possible to establish a uniform surface area of the diaphragm plate that is pressurized by the piezoelectric elements. Further, by using a synthetic resin layer with excellent chemical resistance, it is possible to prevent ink from corroding the diaphragm plate.

U.S. Pat. No. 4,751,774 discloses a technology for bonding molded protruding members (feet) to the ends of transducer elements.

When bonding the diaphragm plate to a channel member, it is necessary to precisely align ink chambers formed in the channel member with the protrusions formed on the diaphragm plate in order to ensure stability and precision in producing and ejecting ink droplets. However, deviations in the relative positions of the channel member and the diaphragm plate tend to occur when the channel member is formed of a material with low thermal expansion, such as silicon, and the diaphragm plate is formed of a synthetic resin material with high thermal expansion. In this case, complex processes are required to position the members precisely, and the types of adhesives that can be used to bond the members are limited.

Further, when producing precise protrusions through etching or electroforming while achieving a dense arrangement of nozzles, the protrusions need to be formed thin, and so the resultant protrusions have less rigidity. For example, if the nozzles are arranged with a density of 75 nozzles per inch (npi) or greater, the rigidity of the protrusion is markedly lower, causing the protrusions to deform when the piezoelectric elements are driven to vibrate the diaphragm plate. Further, even if the ink chambers and the protrusions on the diaphragm plate are aligned precisely, the relative positions of the piezoelectric elements and a plate that supports the piezoelectric elements may become offset. There may be also deviation in the positions of active layers inside the piezoelectric elements. These positional deviations may cause the protrusions to apply pressure at positions off-center with respect to the ink chambers, preventing the protrusions from properly fulfilling their functions.

It is also difficult to bond the molded protruding members to the ends of transducer elements when the density of nozzles in the inkjet head is 75 npi or greater.

SUMMARY OF THE INVENTION

In the view of foregoing, it is an object of the present invention to overcome the above problems, and also to provide an inkjet head capable of reducing variations in ink ejection characteristics among nozzles and achieving high-quality printing, even when there are variations in the formation of the piezoelectric elements, by ensuring a stable position and amount of pressure applied to the ink chambers.

In order to achieve the above and other object, according to one aspect of the present invention, there is provided an inkjet head includes a nozzle plate formed with a plurality of nozzles arranged in a row along a first direction, a chamber plate formed with a plurality of pressure chambers, a plurality of piezoelectric elements that cause pressure changes in the pressure chambers in response to application of electric signals, each of the piezoelectric elements having an active section, a diaphragm plate attached to the chamber plate, and a plurality of relay members joining the diaphragm plate and the piezoelectric elements. A length of each relay member in a second direction orthogonal to the first direction is shorter than a length of each piezoelectric element and longer than a length of the active section in each piezoelectric element with respect to the second direction.

There is also provided an inkjet recording device including an inkjet head and a head base that supports the inkjet head. The inkjet head includes a nozzle plate formed with a plurality of nozzles arranged in a row along a first direction, a chamber plate formed with a plurality of pressure chambers, a plurality of piezoelectric elements that cause pressure changes in the pressure chambers in response to application of electric signals, each of the piezoelectric elements having an active section, a diaphragm plate attached to the chamber plate, and a plurality of relay members joining the diaphragm plate and the piezoelectric elements. A length of each relay member in a second direction orthogonal to the first direction is shorter than a length of each piezoelectric element and longer than a length of the active section in each piezoelectric element with respect to the second direction.

PREFERRED EMBODIMENT OF THE PRESENT INVENTION

Next, an inkjet recording device employing an inkjet head according to a preferred embodiment of the present invention will be described while referring to the accompanying drawings.

Figure 1:
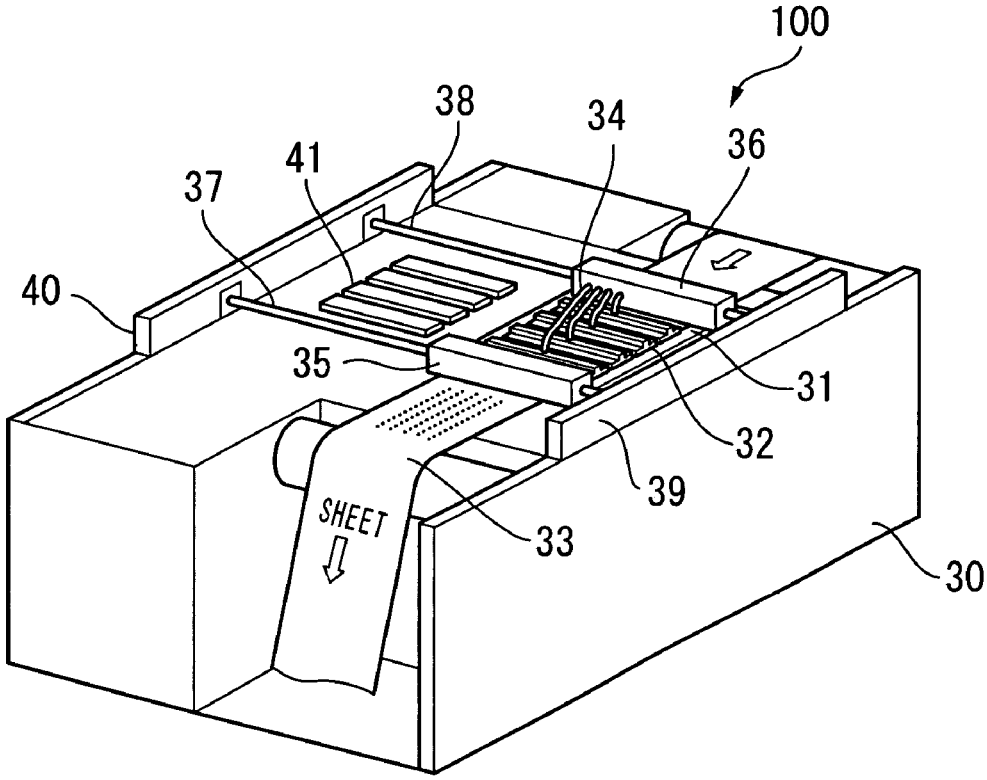
FIG. 1 is a perspective view showing an inkjet recording device according to an embodiment of the present invention.

As shown in FIG. 1, an inkjet recording device 100 according to the present embodiment includes a casing 30 and a head base 31. Although not shown in the drawings, a roll-sheet transport unit and a control unit are housed in the casing 30. Also, a roll-sheet supply unit is disposed at the rear side of the casing 30. The roll-sheet transport unit transports a roll sheet 33 supplied from the roll-sheet supply unit in the direction indicated by arrows in FIG. 1.

Frames 39, 40 are formed at the upper left and right sides of the casing 30. Rods 37, 38 are supported between the frames 39, 40. Support members 35, 36 are slidably supported on the rods 37, 38, and the head base 31 is attached to the support members 35, 36. Four head units 32 are supported on the head base 31. The support members 35, 36 are slidable in the widthwise direction of the roll sheet 33 to move the head units 32 to the position of a head cleaning mechanism 41.

The four head units 32 are supplied with cyan-, magenta-, yellow-, and black-colored ink, respectively, from ink tanks (not shown) through four ink supply tubes 34. Also, each of the head units 32 includes a plurality (20 in this example) of inkjet heads 32A (FIG. 2) aligned in the widthwise direction of the roll sheet 33.

Each head 32A is provided with a plurality of nozzles 2 (FIG. 3), and the roll sheet 33 is conveyed directly opposite from the nozzles 2.

Figure 2:
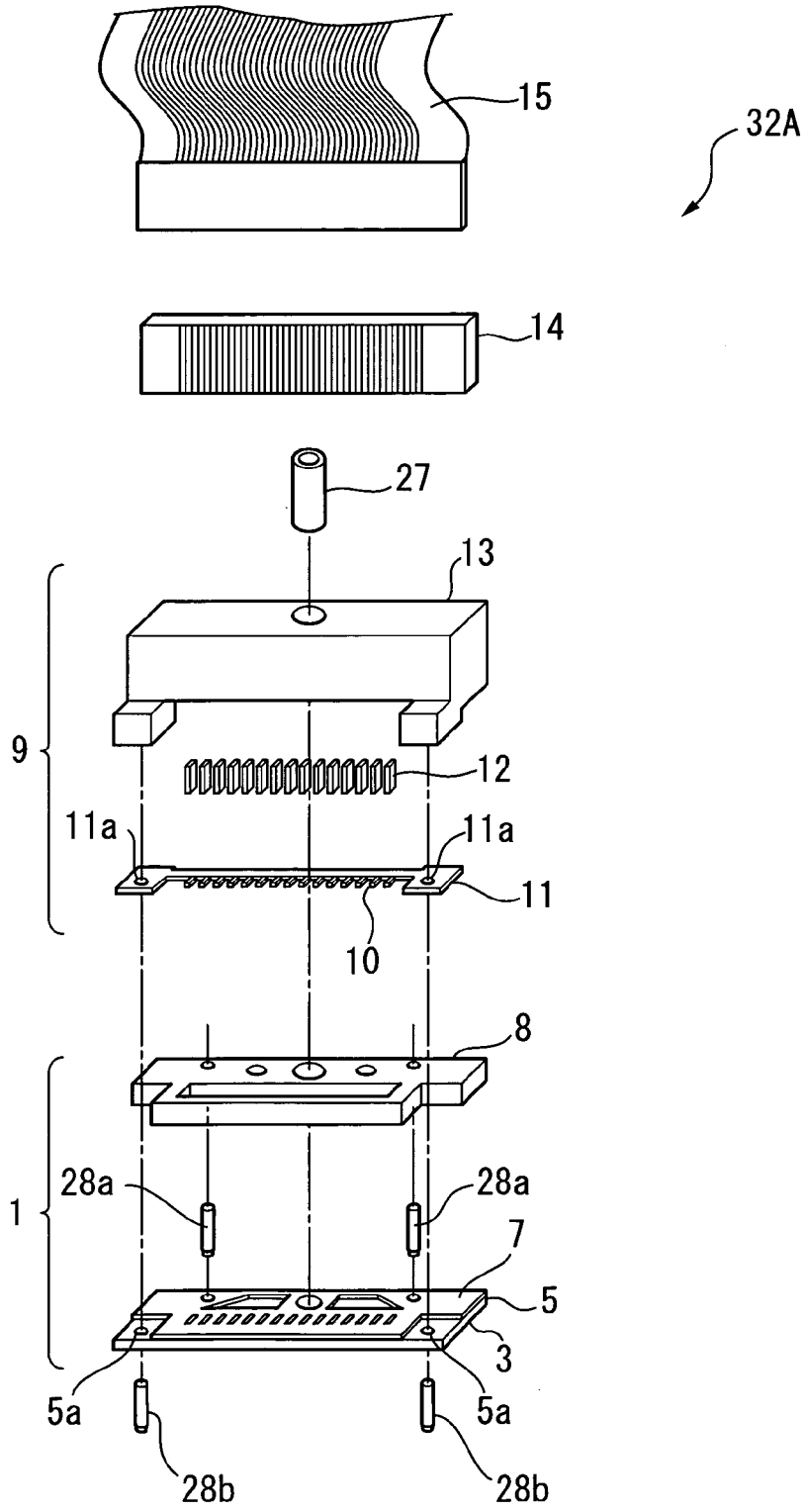
FIG. 2 is an exploded perspective view showing an inkjet head according to the embodiment of the present invention.

FIG. 2 is an exploded perspective view of the head 32A. As shown in FIG. 2, each head 32A includes a channel section 1, a drive section 9, a ceramic plate 14, and a flexible printed circuit (FPC) 15. The FPC 15 has wiring for supplying electricity to piezoelectric elements 12 described later.

The channel section includes a nozzle plate 3, a chamber plate 5, a diaphragm plate 7, and a reinforcing plate 8, all of which components are bonded together by adhesive sheets (not shown) while held in position by reference pins 28*a*. The drive section 9 includes a relay plate 11, the piezoelectric elements 12, and a support base 13. The support base 13 is connected to the ink supply tube 34 via an ink introducing tube 27.

Figure 3:
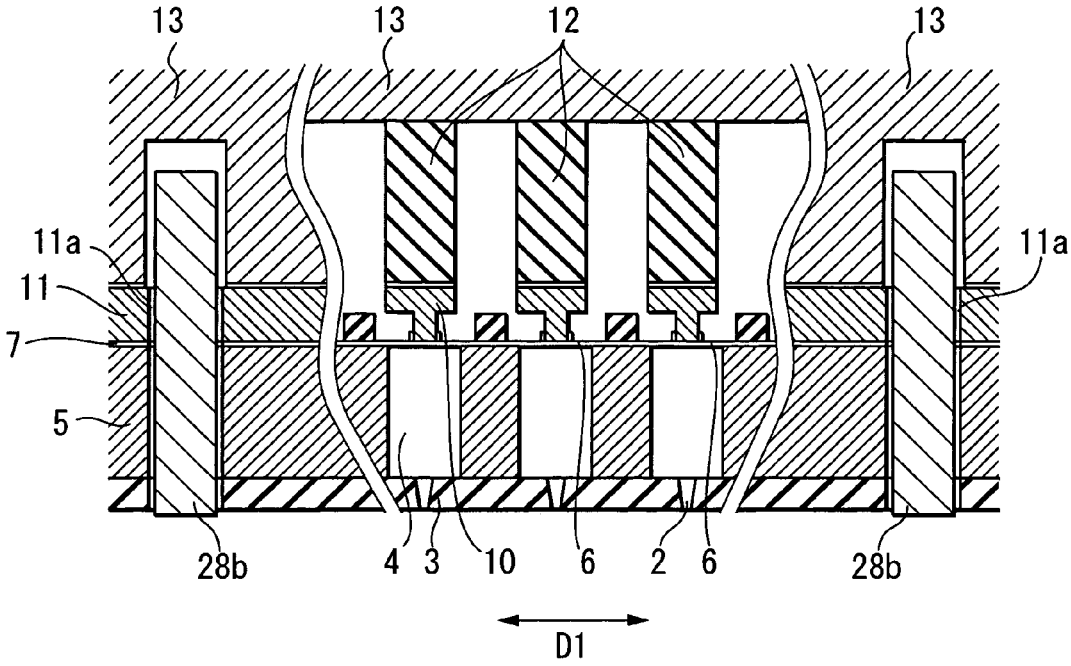
FIG. 3 is a cross-sectional view of the inkjet head of FIG. 2.

As shown in FIG. 3, the plurality of nozzles 2 (128 nozzles in the this embodiment) is formed in the nozzle plate 3 to align in a direction D1. A plurality of ink chambers 4 is formed in the chamber plate 5. The diaphragm plate 7 is attached to the chamber plate 5, and portions of the diaphragm plate 7 serve as diaphragms 6 which serve as walls of the respective ink chambers 4. The reinforcing plate 8 functions to reinforce ink channels. The ink chambers 4 are provided in a one-to-one correspondence with the nozzles 2.

The relay plate 11 is formed of silicon integrally with a plurality of relay members 10 having a one-to-one correspondence to the ink chambers 4. Each of the piezoelectric elements 12 has an electrode part (not shown) electrically coupled with the ceramic plate 14 (FIG. 2) through a conductive paste.

As shown in FIG. 2, reference holes 11*a* are formed in the relay plate 11 for positioning the same, while similar reference holes 5*a* are formed in the chamber plate 5. The channel section 1 and the drive section 9 are positioned relative to each other by reference pins 28*b* inserted in these reference holes 11*a* and 5*a*, enabling the relay members 10 and the ink chambers 4 to be positioned relative to each other with high precision. In this embodiment, the relay plate 11 and the chamber plate 5 are formed of silicon using a highly precise wet etching or dry etching process to achieve a high processing precision (to align the relay members 10 with the ink chambers 4) with an error of ∓2 μm or less. The piezoelectric element may be either a d31 or a d33 type, but the present embodiment employs the d33 type for the ease of running a signal line from an external electrode.

The drive section 9 is manufactured in the following manner. First, an intermediate plate member (not shown), piezoelectric member (not shown), and the support base 13 are bonded by a heat-resistant adhesive or the like. Next, the ceramic plate 14 is bonded to the back surface of the piezoelectric member (the surface opposite that bonded to the intermediate plate member), with a conductive paste forming an electrical connection between conducting parts of the ceramic plate 14 and the piezoelectric member. Subsequently, the intermediate plate member, piezoelectric member, and the ceramic plate 14 are cut at intervals of a prescribed width using a dicer or the like, thereby obtaining separated drive section members (the relay members 10 and the piezoelectric elements 12) corresponding to each nozzle 2.

Figure 4:
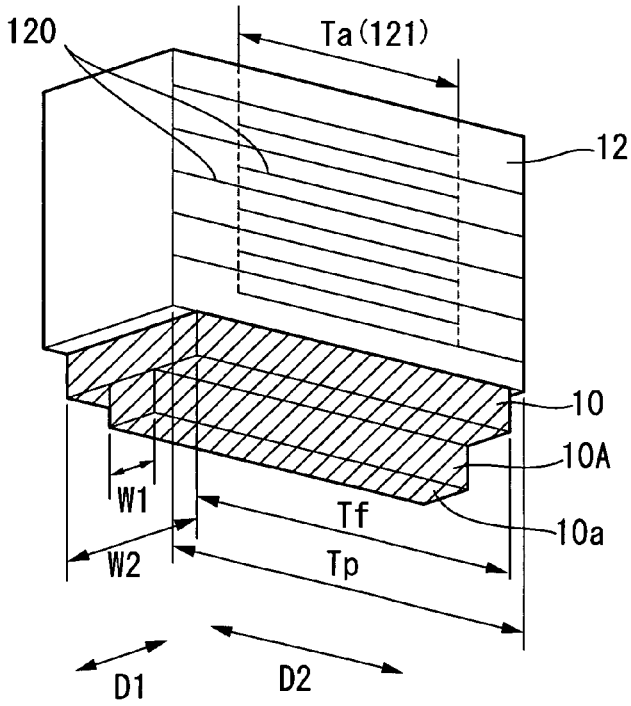
FIG. 4 is an enlarged view of a piezoelectric element and a relay member for one nozzle in the inkjet head of FIG. 2.

FIG. 4 is an enlarged view of one of each of the relay members 10 and the piezoelectric elements 12 for one nozzle 2. A protruding part 10A is formed in the relay member 10 by dicing away areas other than the protruding part 10A using a dicer or by half-etching parts other than the protruding part 10A by a wet etching or dry etching method. A width W1 of the protruding part 10A in a direction D1 shown in FIG. 4 is narrower than a width W2 of the piezoelectric element 12. A surface 10*a* of the protruding part 10A is bonded to the corresponding diaphragm 6.

By forming the protruding parts 10A on the relay members 10 in this way, the areas vibrated on the diaphragms 6 (part of the diaphragm 6 that receives pressure by the relay member 10) can be spaced more closely. Specifically, by bonding areas of the diaphragm plate 7 surrounding each diaphragm 6 to the walls of the ink chamber 4, the diaphragm 6 does not deform as readily. Accordingly, applying pressure precisely near the center of each diaphragm 6 can ensure that a stable pressure is applied to the diaphragms 6 to achieve a uniform amount of deformation. Without the protruding part 10A, it would be necessary to allocate more surface area for the diaphragm 6 in order to prevent a minute error in the position at which pressure is applied to the diaphragm 6 from affecting adjacent ink chambers 4. By forming the protruding part 10A, however, the surface area of the diaphragm 6 at which pressure is applied can be made smaller than the surface area of the piezoelectric element 12 so that pressure need only be applied to the stable displacement region near the center of the diaphragm 6. Hence, the surface area allocated for the diaphragm 6 may be decreased, enabling a smaller pitch between adjacent ink chambers 4 and, hence, a denser arrangement of the areas pressurized by vibrations of the diaphragms 6.

Since the relay members 10 and the piezoelectric elements 12 (the intermediate plate member and the piezoelectric member) are bonded together before being diced as described above, positional deviations between the relay members 10 and the piezoelectric elements 12 do not occur in the direction D1. However, positioning in the direction D2 orthogonal to the direction D1 cannot be as precise as in the direction D1 due to bending and warping of the piezoelectric member. Further, the position of an active section 121, which is formed of overlapping portions of internal electrodes 120 in the piezoelectric element 12, may deviate with respect to the relay member 10 in the direction D2 due to positional deviations in or irregular lengths of the internal electrodes 120.

Figure 5:
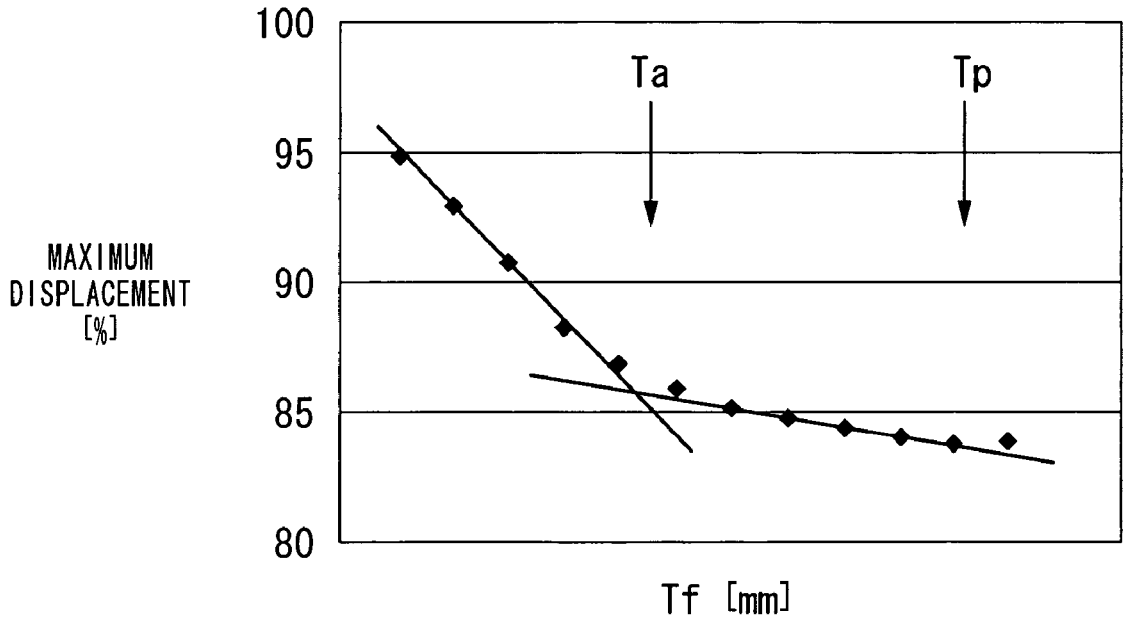
FIG. 5 is a graph showing the relationship between a length of the relay member and a maximum displacement of the piezoelectric element.

FIG. 5 is a graph showing variations in maximum displacement of the piezoelectric element 12 when varying a length Tf of the relay member 10 in the direction D2. It should be noted that the maximum displacement in the graph indicates the ratio (%) of maximum displacement amount by which a piezoelectric element 12 attached to the diaphragm 6 via the relay member 10 deforms when driven to a maximum displacement amount by which the piezoelectric element 12 deforms when driven without being attached to the diaphragm 6. From the graph, it is apparent that the maximum displacement increases as the length Tf is shortened. However, when the length Tf is shortened less than a width Ta of the active section 121, the displacement increases at a much higher rate than when the length Tf is greater than the width Ta. This indicates that if the length Tf is less than the width Ta of the active section 121, displacement in the piezoelectric element 12 changes more significantly in response to positional deviations of the active section 121 or relative positional deviations between the piezoelectric element 12 and the relay member 10 in the direction D2. Since the amount of pressure applied to the ink chamber 4 also changes in response to changes in displacement of the piezoelectric element 12, these changes in displacement can greatly affect ink ejection characteristics.

In contrast, if the length Tf is longer than the width Ta of the active section 121, displacement of the piezoelectric element 12 does not change much in response to positional deviations of the active section 121 or relative positional deviations of the piezoelectric element 12 and the relay member 10 in the direction D2. Hence, such changes in displacement have little effect on ink ejection characteristics. Accordingly, uniform ink ejection characteristics can be achieved.

Further, if the length Tf is greater than a length Tp of the piezoelectric element 12, a portion of the relay member 10 protrudes beyond the piezoelectric element 12 and is not supported by the piezoelectric element 12. This portion of the relay member 10 is more easily influenced by vibrations in the diaphragm 6. Further, pressure is applied to the relay member 10 when bonded to the channel section 1, and the relay member 10 is formed of silicon, which is brittle. Therefore, if the length Tf is greater than the length Tp of the piezoelectric element 12, pressure applied to the relay member 10 may cause the relay member 10 to chip, changing the surface area of the diaphragm 6 to which pressure is applied. The pressurized surface area of the diaphragm 6 can be kept uniform if the length Tf is less than the length Tp of the piezoelectric element 12. From this data, it is desirable to set the length Tf in the range $Ta<Tf<Tp$.

In the embodiment described above, the length Tf of the relay member 10 is set longer than the width Ta of the active section 121 and shorter than the length Tp of the piezoelectric element 12. Accordingly, the piezoelectric element 12 can apply a stable amount of pressure to the ink chamber 4 via the diaphragm 6 at a precise position to achieve stable ink ejection. Therefore, an inkjet head that achieves high-quality printing can be provided.

Since the relay members 10 can be manufactured according to a process different from a process of manufacturing the diaphragm 6 according to the present embodiment, thick relay members 10 with good rigidity can be produced even when the relay members 10 are manufactured with high precision. By producing relay members 10 with high rigidity, it is possible to reduce variations in displacement of the piezoelectric elements 12 and the amount of pressure applied by the relay members 10 due to distortion and positional deviations of the active section 121 in the piezoelectric element 12.

While some exemplary embodiments of this invention have been described in detail, those skilled in the art will recognize that there are many possible modifications and variations which may be made in these exemplary embodiments while yet retaining many of the novel features and advantages of the invention.

For example, the present invention can be applied to an inkjet head used in recording devices other than the one described in the preferred embodiment, such as a small all-purpose inkjet recording device.

What is claimed is:

1. An inkjet head comprising:

a nozzle plate formed with a plurality of nozzles arranged in a row along a first direction;

a chamber plate formed with a plurality of pressure chambers;

a plurality of piezoelectric elements constructed and arranged to cause pressure changes in the pressure chambers in response to application of electric signals, each of said piezoelectric elements having an active section; each piezoelectric element having a piezoelectric element width in said first direction, a piezoelectric element length in a second direction orthogonal to said first direction, and an active section having an active section length in said second direction that is less than said piezoelectric element length;

a diaphragm plate attached the said chamber plate; and a plurality of relay members joining the diaphragm plate and said plurality of piezoelectric elements, wherein each relay member has a relay member length in said second direction and said relay member length is shorter than said piezoelectric element length and longer than said active section length.

2. An inkjet head according to claim 1, wherein each relay member has a surface that is bonded to the diaphragm plate, and said surface has a width in said first direction that is shorter than said piezoelectric element width.

3. An inkjet head according to claim 1, further comprising a relay plate formed with the plurality of relay members, the relay plate being silicon.

4. An inkjet head according to claim 3, wherein said relay plate is formed by dry etching.

5. An inkjet head according to claim 3, wherein said relay plate is formed by wet etching.

6. An inkjet recording device comprising:

an inkjet head according to claim 1; and a head base that is constructed and arranged to support said inkjet head.

7. An inkjet recording device according to claim 6, wherein each relay member has a surface that is bonded to the diaphragm plate, and said surface has a width in said first direction that is shorter than said piezoelectric element width.

8. An inkjet recording device according to claim 6, wherein said inkjet head further includes a relay plate formed with the plurality of relay members, said relay plate being silicon.

9. An inkjet recording device according to claim 8, wherein said relay plate is formed by dry etching.

10. An inkjet recording device according to claim 8, wherein said relay plate is formed by wet etching.

* * * * *